United States Patent [19]

Dimmick et al.

[11] Patent Number: 4,792,026

[45] Date of Patent: Dec. 20, 1988

[54] APPARATUS FOR LOCKING A CARRYING CASE

[75] Inventors: Gary S. Dimmick, Pittsburgh; Scott G. Lockerman, Sewickley, both of Pa.

[73] Assignee: Lockman Products Company, Inc., Pittsburgh, Pa.

[21] Appl. No.: 78,107

[22] Filed: Jul. 27, 1987

[51] Int. Cl.[4] ..... A45G 13/18

[52] U.S. Cl. ..... 190/101; 150/102; 383/97; 70/68; 190/120

[58] Field of Search ..... 190/101, 120, 903, 113; 150/102; 206/810; 383/97; 70/68

[56] References Cited

U.S. PATENT DOCUMENTS

| | | | |
|---|---|---|---|
| 2,115,993 | 5/1938 | Kranhold | 190/903 X |
| 2,183,121 | 12/1939 | Levine | 190/903 X |
| 3,319,743 | 5/1967 | Pelavin et al. | 190/120 |
| 3,597,945 | 8/1971 | Feinberg | 190/903 X |
| 3,777,862 | 12/1973 | Zipper | 190/903 X |
| 4,031,723 | 6/1977 | Samhammer et al. | 190/903 X |
| 4,213,314 | 7/1980 | Trader | 190/903 X |
| 4,366,684 | 1/1983 | Bako et al. | 190/903 X |
| 4,703,519 | 10/1987 | Krenzel | 190/903 X |

FOREIGN PATENT DOCUMENTS

| | | | |
|---|---|---|---|
| 958094 | 3/1950 | France | 190/113 |

*Primary Examiner*—William Price

*Attorney, Agent, or Firm*—Buchanan Ingersoll

[57] ABSTRACT

A carrying case having a zipper-type closure element includes a pair of spaced apart pockets for receiving a cylindrical locking device carrying a lockable safety pin pivotal into and out of a closed position with a lock element. The locking device is retained in the pockets oppositely of the closure element when the carrying case is closed. The pin in the open position engages the closure element and is pivoted to the closed position to prevent movement of the closure element to open the carrying case. A length of strap extending from the case may be wrapped around a stationary object and secured to the closed pin to prevent theft of the carrying case.

10 Claims, 1 Drawing Sheet

APPARATUS FOR LOCKING A CARRYING CASE

BACKGROUND

1. Field of the Invention

This invention relates to a carrying case and more particularly to a carrying case adapted to receive a locking device for securing the carrying case in a closed position and also locking the carrying case to a fixed object to prevent theft of the carrying case.

2. Description of the Prior Art

Locks for carrying cases particularly handbags, suitcases, briefcases, attaches, and the like are well known. Among the locking devices that are commonly used with these types of carrying cases are key locks, combination locks, barrel-type combination locks, and various latches that are used to open and close the carrying case even though the carrying case may not be locked in a closed position. In addition to securing a handbag or a suitcase in a closed position, a number of efforts have been made to provide locking devices to secure the carrying case to a stationary object to prevent theft of the carrying case when unattended for a period of time.

A common method for securing a carrying case to a stationary object is the use of a conventional chain and padlock. U.S. Pat. No. 1,586,113 discloses a theftproof bag in which a chain with a swivel is attached at one end to the handle of a bag and a shackle-type device is connected at the other end for lockable engagement to the wrist of the individual carrying the bag. In the alternative, the shackle-type device could be secured to a stationary object to prevent theft of the bag.

A snatchproof handle for handbags and the like is disclosed in U.S. Pat. No. 4,116,253. With this device, two straps are secured each to opposite sides of the article and then the straps are twisted to form a loop through which a person's hand is inserted. Each loop is stretchable to fit different sizes of the hands and provides a means by which the handbag can be firmly held to prevent theft, or by purse snatching.

It is also well known to use link chains associated with a closure element of a case or traveling bag to prevent unauthorized displacement of the bag. Examples of such devices are disclosed in U.S. Pat. Nos. 359,219; 1,532,710; and 1,643,189; British Pat. No. 399,017 and Federal Republic of Germany OLS No. 3,105,467.

It is also known to provide a traveling bag with means for carrying objects, such as umbrellas and canes, on the device. U.S. Pat. No. 746,617 discloses apparatus for retaining an umbrella on a traveling bag where the umbrella is locked to the traveling bag to prevent removal until the bag has first been opened.

While it has been suggested by the prior art devices to provide means for securing a carrying case to a fixed object or the hand of the individual carrying the case, the suggested solutions to the problem of preventing theft are limited in the manner in which they are connected to a stationary object or to the hand of the person carrying the case. Also, while it has been suggested to secure in a locked manner an object to a carrying case, there is need to provide a locking device which may be utilized to universally secure a carrying case to a fixed object while at the same time maintain the carrying case in a locked position.

SUMMARY OF THE INVENTION

In accordance with the present invention there is provided a carrying case that includes a pair of side panels positioned in overlying relation to form a compartment. The side panels have pivotally connected sections to permit relative movement of the side panels to open and close the compartment. Closure means extending around the side panels connect the side panels to close the compartment. An actuator is movable on the closure means between a closed position and an open position to connect and disconnect the side panels to close and open the compartment. An elongated body portion is attached to one of the side panels adjacent the closure means. The body portion has a closed end and an open end with an internal cavity extending between the closed and open ends for receiving and supporting a locking device on the side panel. The open end is in juxtaposition with the actuator when the compartment is in the closed position.

Further in accordance with the present invention, there is provided a combination carrying case and lock that includes a pair of side panels positioned in overlying relation to form a compartment. The side panels have pivotally connected sections to permit relative movement of the side panels to open and close the compartment. Closure means extends around the side panels for connecting the panels to seal the compartment. An actuator is movable on the closure means between a sealed position and an open position to connect and disconnect the side panels to seal and open the compartment. Means is provided for supporting a locking device on one of the side panels adjacent the closure means. The locking device has a lock mechanism and a lock element slidably received in the lock mechanism for movement into and out of a locked position with the lock mechanism. A pin has one end connected to the lock element and an opposite end positioned between opened and closed positions with the lock mechanism when the lock element is moved out of and into the locked position. The pin is movable into and out of engagement with the actuator in the sealed position on the closure means to prevent opening of the compartment when the pin is in the closed position.

Additionally in accordance with the present invention, there is provided a method for locking a carrying case that includes the steps of pivotally connecting a pair of side panels in overlying relation to form a compartment of the carrying case. The side panels are moved into and out of overlying relation to open and close the compartment. The side panels are fastened together by slidable closure means movable between an open position and a closed position to open and close the compartment. A lockable safety pin is retained on the carrying case adjacent the closure means. The safety pin is moved in an open position into engagement with the closure means in the closed position. Thereafter, the safety pin is moved to a closed position to retain the closure means in the closed position to prevent opening of the compartment.

Accordingly, the principal object of the present invention is to provide a carrying case having convenient means retained on the case for not only locking the carrying case in a closed position but simultaneously securing the carrying case to a stationary object to prevent theft of the carrying case.

Another object of the present invention is provide method and apparatus for locking a carrying case by a locking device removably retained on the carrying case.

A further object of the present invention is to provide a carrying case having handle or strap means removably connected to the carrying case to facilitate carrying the case and, when desired, securing the carrying case in a locked position to a stationary object.

These and other objects of the present invention will be more completely disclosed and described in the following specification, the accompanying drawings and the appended claims.

DESCRIPTION OF THE PREFERRED EMBODIMENT

Figure 1:
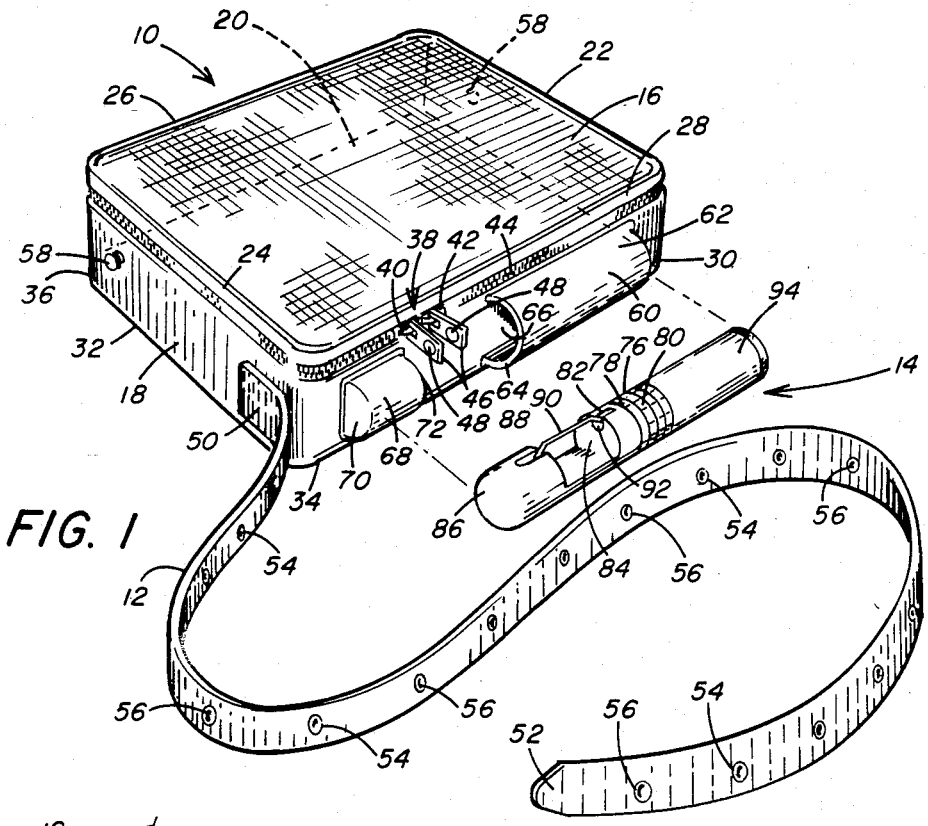
FIG. 1 is a perspective view of a carrying case having a zipper for opening and closing the carrying case and a strap having an end removably connected to the carrying case, illustrating a locking device adapted to be retained on the carrying case for locking the carrying case and securing it to a stationary object.
Figure 2:
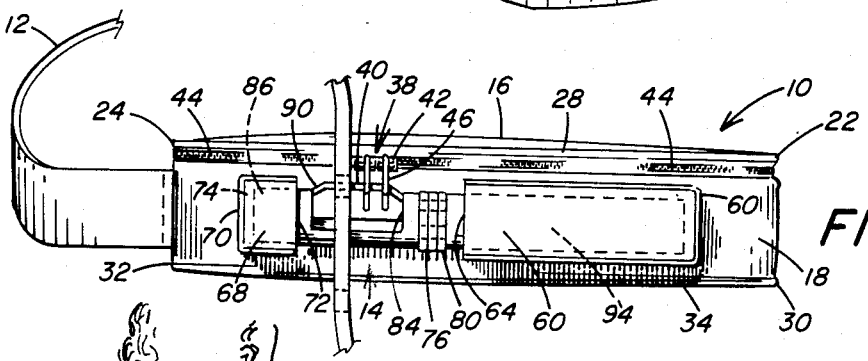
FIG. 2 is a fragmentary view in side elevation of the carrying case shown in FIG. 1, illustrating a locking device retained on the carrying case and engaging the slides of the zipper in a closed position and the strap of the carrying case to lock the carrying case and form a loop for holding the carrying case.

Referring the drawings and particularly to FIGS. 1 and 2 there is illustrated a carrying case generally designated by the numeral 10 having a strap 12 and adapted to receiving a locking device generally designated by the numeral 14 for securing the carrying case 10 in a closed position and locking the carrying case to a fixed object to prevent theft. The carrying case 10 is conventional in design and is exemplary of conventional suitcases, briefcases, attaches and the like. It should be understood that the carrying case 10 illustrated in the drawings is only exemplary of many different types of carrying cases which can be utilized in accordance with the present invention.

The carrying case 10 shown in FIG. 1 includes a pair of side panels 16 and 18 positioned in overlying relation to form an internal compartment 20. The side panel 16 includes a continuous peripheral edge portion formed by a first pair of parallel edges 22 and 24 and a second pair of parallel edges 26 and 28. Similarly the side panel 18 positioned beneath the side panel 16 includes a continuous peripheral edge portion formed by a first pair of parallel edges 30 and 32 and a second pair of parallel edges 34 and 36. As seen in FIGS. 1 and 2, the second or lower side panel 18 has edge portions of a width greater than the width of the edge portions of the top panel 16. The width of the edge portions of the respective side panels is a matter of design choice.

Preferably, the overlying edge portions 26 and 36 are pivotally connected in such a manner to permit relative movement of the side panels 16 and 18 between an open position and a closed position to thereby open and close the compartment 20. The carrying case 10 is shown in a closed position in FIG. 1. Well known means are provided for connecting the panels 16 and 18 along the adjacent edge portions 26 and 36, such as by pivot pins, to facilitate the opening and closing of the carrying case while maintaining the panels 16 and 18 connected to each other when the carrying case is in the open position.

A closure device generally designated by the numeral 38 extends around the overlying peripheral edge portions of the panels 16 and 18 and connects the overlying edge portions to each other to close the compartment 20. A well known closure device is the conventional zipper that includes a slide mechanism for engaging in locking position the interlocking teeth of the zipper. The closure device 38 shown in FIG. 1 includes an arrangement having a pair of zipper slides 40 and 42 operable to interlock in a well known manner zipper teeth 44. A closure element 46 is connected to each zipper slide 40 and 42, and include an aperture 48 therethrough.

In a well known manner movement of the closure elements 46 activates the respective slides 40 and 42 to advance on the zipper teeth 44 and bring the teeth into and out of engagement depending on the direction of movement. As shown in FIG. 1, the closure elements are positioned in a close adjacency where the zipper teeth 44 are engaged completely around the periphery of the carrying case. Accordingly, movement of the closure elements 46 away from each other disengages the zipper teeth 44 to permit the carrying case 10 to be opened. In the closed position of the carrying case, the zipper slides 40 and 42 are shown substantially in abutting relation in FIG. 1.

While a zipper type closure device is shown with the carrying case 10 of the present invention, it should be understood that other types of closure devices can also be utilized in accordance where there includes an element for connecting and disconnecting the panels 16 and 18 and the closure element is movable into and out of a locked position. Other types of closure devices which are adaptable for use with the present invention include snaps, Velcro interlocking strips, other adhesive means, and mechanically engaging elements.

As with conventional carrying cases, carrying case 10 of the present invention includes a strap 12, conventionally known as a shoulder strap, which in most cases includes end portions which are both connected to opposite sides of the carrying case. Preferably with the present invention, the strap 12 includes a first end portion 50 which is secured as by sewing or riveting to the edge portion 32 of side panel 18. An opposite end portion 52 of the strap 12 is a free end portion. Spaced at regular intervals along the length of the strap 12 are snaps 54 having apertures 56 therethrough. The snaps 54 are operable to engage a selected one of the protrusions 58 that extend outwardly from the edge portions 30 and 32 of the lower side panel 18.

Figure 3:
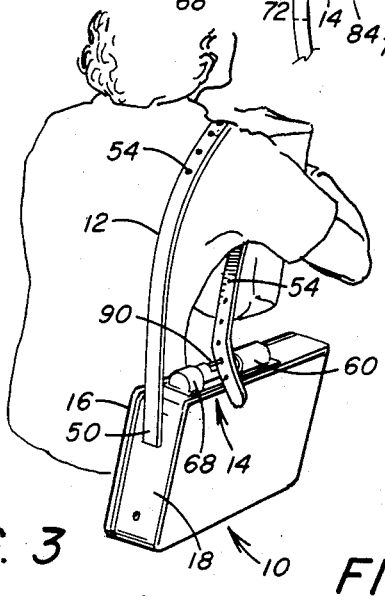
FIG. 3 is a schematic illustration of the manner of connecting the carrying case strap to the locking device retained on the carrying case.

In one method of use, the strap 12 is extended in a loop opposite the panel edge portions 28 and 34 around to the opposite panel edge portion 30 for engagement with one of the protrusions 58. If it is desired to increase the size of the loop in the strap 12, one of the snaps 54 adjacent the free end portion 50 can be secured to the protrusion 58 on the lower side panel 32. Further in accordance with the present invention, the strap 12 can be engaged by the locking device 14 on the carrying case for forming a loop in use of the strap 12, as shown in FIG. 3.

Preferably on the edge portion 34 of the side panel 18 where the closure device 38 is in the closed position is provided a means for retaining the locking device 14 on the carrying case 10, as shown in FIG. 2. A first elongated body portion 60 is attached to the edge portion 34 of side panel 18 adjacent the closure device 38 when in a closed position. The body portion 60 has a closed end 62 and an open end 64 with an internal cavity 66 extending between the closed end 62 and the open end 64 for receiving and supporting the locking device 14.

As seen in FIGS. 1 and 2, the open end 62 is in juxtaposition with the pair of closure elements 46. Also to further facilitate secure retention of the locking device 14 on the carrying case 10, a reduced body portion 68 is positioned in spaced relation opposite the elongated body portion 60 on the opposite side of the closure device 38 as shown in FIG. 1. The reduced body portion 68 also includes a closed end 70 and an open end 72 with an internal cavity 74 extending between the closed end 70 and the open end 72 for also receiving a part of the locking device 14.

The locking device 14 has a barrel-type combination lock 76 which is conventional in design and will not be described in detail. Known barrel-type combination locks are disclosed in U.S. Pat. Nos. 1,222,920; 1,267,894; 1,472,206; and 1,627,462. The lock 14 has a barrel 78 upon which are received a plurality of tumbler wheels 80. The tumbler wheels have recesses (not shown) so that when the recesses are aligned, the lock is in a open position as illustrated in phantom in FIG. 1.

When the recesses are not aligned, the lock is in a locked position in a manner that is well known in the art. The tumbler wheels 80 have numerals (not shown) around the circumference of each wheel 80 so that when the recesses are aligned the numerical combination of the lock appears in alignment on adjacent tumbler wheels in conventional fashion.

Formed in one end of the barrel 78 is a pin receiving recess 82. A lock element 84 moves in sliding, axial relation to the barrel 78 between the locked position and the unlocked position. When the tumbler wheels 80 are positioned so that the lock is in the open position, the lock element 84 is freely slidable through the barrel 78. In order to lock the combination lock 76, the lock element 84 is moved to the closed position. Then the tumbler wheels 80 are rotated. In the locked position, the tumbler wheels 80 enter recesses (not shown) formed on the lock element 84 to prevent the lock element 84 from moving relative to the barrel 78.

The locking device 14 used with the carrying case 10 in accordance with the present invention is disclosed in detail in co-pending U.S. application Ser. No. 874,220, now U.S. Pat. No. 4,682,481 entitled "Personal Locking Device". Therefore the detailed description of the locking device disclosed in prior co-pending application Ser. No. 874,220 now U.S. Pat. No. 4.682,481 is incorporated herein by reference.

The lock element 84 includes a safety pin housing 86 which is of generally cylindrical shape to be received within the internal cavity 74 of the reduced body portion 68. The safety pin housing 86 has a groove 88 formed to receive the pivoted end of a safety pin 90. The safety pin 90 is movably retained on the pin housing 86 by pivotally connecting the safety pin 90 to the safety pin housing 86. The safety pin housing 86 also has a pin receiving groove 92 to receive the free end of the safety pin 90 when the safety pin 90 is in the closed position.

When the safety pin 90 is closed the free end of the safety pin 90 is positioned in the pin receiving groove 92. A portion of the safety pin 90 protrudes beyond the safety pin housing 86 and into the pin receiving recess 82 of barrel 78. With the lock element 84 in the locked position the safety pin 90 is locked in the closed position and may not be opened. When the lock element 84 is moved to the open position the end of the safety pin 90 is withdrawn from the pin receiving recess 82 and may be pivoted about the safety pin housing 86 to the open position.

Extending from the barrel 78 opposite from the safety pin housing 86 is an attached cylindrical container 94 adapted to receive, as described in further detail in the abovereferenced co-pending application, a link chain which may be engaged by the safety pin 90 as a further means of securing the locking device 14 to a stationary object. The cylindrical container 94 is retained on the carrying case 10 within the internal cavity 66 of the elongated body portion 60.

FIG. 2 illustrates the manner in which the locking device 14 is used to maintain the closure device 38 in a closed position to prevent unauthorized opening of the carrying case 10. The carrying case 10 is locked by extending the safety pin 90 in an open position through the aligned apertures 48 of the closure elements 46 when positioned in adjacent relation. With the safety pin 90 passing through the closure elements 46 the free end of the safety pin 90 is locked in the above-described manner within the pin receiving recess 82 of the barrel 78.

The locking device 14 is locked to the closure device 38 with the safety pin housing 86 positioned in the reduced body portion 68 and the cylindrical container 94 positioned in the elongated body portion 60. This prevents the locking device from being moved away from the carrying case 10. Thus the locking device 14 cannot be removed from the body portions 60 and 68 until the safety pin 90 is unlocked and removed from engagement with the closure device 38. In this manner the locking device 14 is used to close the carrying case 10, while the locking device 14 is, in turn, securely retained on the carrying case 10.

In addition to preventing the carrying case 10 from being opened by use of the locking device 14, the carrying case 10 can be secured to a stationary object or the strap 12 can be connected to the locking device 14 to facilitate carrying the case on one's shoulder as shown in FIG. 3. As seen in FIG. 2, connection of the strap 12 to the locking device 14 is facilitated by extending the safety pin 90 when in an open position through a selected one of the snaps 54. It may be preferred to connect the free end 52 of the strap 12 to one of the protrusions 58 to form a shoulder strap. On the other hand connecting the strap free end 52 to the lock safety pin 90 locks the strap 12 in a loop.

When the strap 12 engages one of the other protrusions 58 to form a loop, the strap 12 can be readily separated from the protrusion 58. When the safety pin 90 is extended through one of the apertures 56, the safety pin 90 must be unlocked before the loop can be opened. This provides a versatile means of using the safety pin 90 to form not only a shoulder strap but also as a means to extend the strap in a loop around a stationary object to temporarily secure the carrying case 10 to the stationary object.

Figure 4:
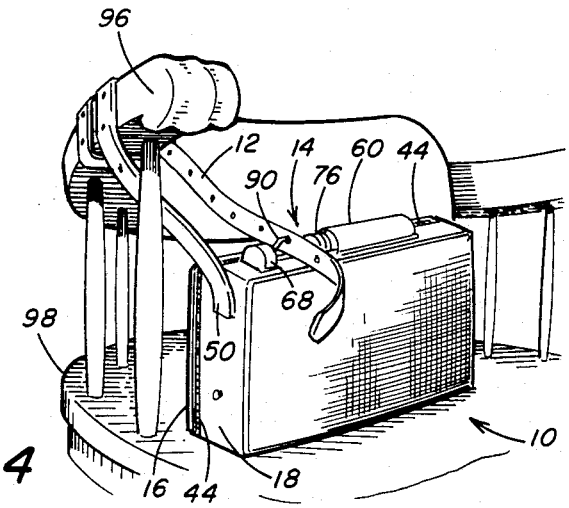
FIG. 4 is a schematic illustration of the carrying case secured to a stationary object by wrapping the strap around the object and connecting it to the locking device.

FIG. 4 illustrates an example of use of the carrying case 10 in combination with the locking device 14 to secure the carrying case 10 to an arm 96 of a chair 98. In this application the free length of strap 12 is looped several times around the arm 96. The strap end 52 is then extended to position the open safety pin 90 through one of the apertures 56. Then as illustrated in FIG. 2 the end of the safety pin 90 is extended through the aligned apertures 48 of the closure elements 46 and into the pin receiving recess 82 of the barrel 78. When the safety pin 90 is in the closed position in the recess 82, the tumbler wheels 80 are rotated. This locks the safety pin 90 in the closed position.

When the safety pin 90 is in the locked position on the barrel 78 not only is the carrying case 10 locked in the closed position but also the carrying case 10 is secured to the chair 98. Thus a convenient arrangement is available for securing the carrying case 10 by the locking device 14 to a stationary object. At the same time, the locking device 14 becomes an integral part of the carrying case 10.

The locking device 14 is always conveniently available for use on the carrying case 10. When not needed for locking operations, the locking device 14 is retained in the body portions 60 and 68 with the safety pin 90 locked in the pin receiving recess 82 but not engaging the closure device 38. This permits the closure device 38 to be freely opened and closed without having to unlock the locking device 14 to open the carrying case 10. Thus in operation with the locking device 14, the carrying case 10 can be utilized in a variety of methods to not only maintain the carrying case 10 closed but secured to a stationary object.

According to the provisions of the patent statutes, we have explained the principle, preferred construction and mode of operation of our invention and have illustrated and described what we now consider to represent its best embodiment. However, it should be understood that, within the scope of the appended claims, the invention may be practiced otherwise than as specifically illustrated and described.

We claim:

1. A carrying case comprising, a pair of side panels positioned in overlying relation to form a compartment, said side panels having pivotally connected sections to permit relative movement of said side panels to open and close said compartment, closure means extending around said side panels for connecting said side panels to close said compartment, an actuator movable on said closure means between a closed position and an open position to connect and disconnect said side panels to close and open said compartment, a locking device including a locking pin movable between a locked position and an unlocked position, an elongated body portion attached to one of said side panels adjacent said closure means, said body portion having a closed end and an open end with an internal cavity extending between said closed and open ends for removably receiving and supporting said locking device on said side panel, said open end portion being in juxtaposition with said actuator when said compartment is in said closed position, and said locking pin being engageable with said actuator when said compartment is in said closed position to prevent opening of said compartment when said pin is in said closed position and to secure said locking device to said respective side panel.

2. A combination carrying case and lock comprising, a pair of side panels positioned in overlying relation to form a compartment, said side panels having pivotally connected sections to permit relative movement of said side panels to open and close said compartment, closure means extending around said side panels for connecting said side panels to seal said compartment, an actuator movable on said closure means between a sealed position and an open position to connect and disconnect said side panels to seal and open said compartment, a locking device, means for supporting said locking device on one of said side panels adjacent said closure means, said locking device including a lock mechanism and a lock element slidably received in said lock mechanism for movement into and out of a locked position with said lock mechanism, a pin having one end connected to said lock element and an opposite end movable between an open position and a closed position with said lock mechanism when said lock element is moved out of and into said locked position, and said pin being movable into and out of engagement with said actuator in said sealed position on said closure means to prevent opening of said compartment when said pin is in said closed position.

3. A carrying case as set forth in claim 1 in which, said actuator includes a pair of zipper slides engageable with said closure means including zipper teeth, each of said zipper slides having an aperture therethrough, and said locking pin extending through said apertures when said zipper slides are adjacently positioned and secured in a locked position to prevent movement of said zipper slides relative to said zipper teeth.

4. A carrying case as set forth in claim 1 which includes, a strap having opposite end portions, a first end portion being connected to a selected one of said side panels, a second end portion being a free end portion, a plurality of apertures extending through said strap at spaced intervals along the length of said strap, and said locking pin extending through a selected one of said apertures and engageable with said actuator to form a shoulder strap on the carrying case.

5. A carrying case as set forth in claim 1 which includes, a reduced body portion positioned in spaced relation on said side panel opposite said elongated body portion, and said reduced body portion including a closed end and open end forming an internal cavity therebetween for receiving one end of said locking device.

6. A carrying case as set forth in claim 1 in which, said locking pin is pivotal on said locking device between said locked and unlocked positions with said actuator positioned on said locking pin to permit engagement and disengagement of said actuator with said locking pin.

7. A combination carrying case and lock as set forth in claim 2 in which, said means for supporting said locking device includes a body portion attached to one of said side panels adjacent said closure means, and said body portion having a closed end and an open end with an integral cavity extending between said closed and open ends for removably receiving and supporting said locking device on said side panel.

8. A combination carrying case and lock as set forth in claim 2 in which said means for supporting said locking device includes means for retaining said locking device on one of said side panels with said pin in said locked position and removed from connection with said actuator to permit opening and closing of said compartment.

9. A carrying case as set forth in claim 2 which includes, elongated means extending from one of said side panels for engagement with a stationary object, and said pin being engageable with said elongated means in said closed position to prevent separation of said elongate means from the stationary object.

10. A carrying case as set forth in claim 2 which includes, strap means connected to one of said side panels and adjustably engageable with said pin in said closed position to form a shoulder strap for carrying the carrying case.

* * * * *